US005765518A

United States Patent [19]

Nakano

[11] Patent Number: 5,765,518

[45] Date of Patent: Jun. 16, 1998

[54] ENGINE VALVE ADJUSTING APPARATUS

[75] Inventor: Shuji Nakano, Toyota, Japan

[73] Assignee: Toyota Jidosha Kabushiki Kaisha, Toyota, Japan

[21] Appl. No.: 859,135

[22] Filed: May 20, 1997

[30] Foreign Application Priority Data

May 21, 1996 [JP] Japan ..... 8-125784

[51] Int. Cl.[6] ..... F01L 1/344

[52] U.S. Cl. ..... 123/90.17; 123/90.31

[58] Field of Search ..... 123/90.15, 90.17, 123/90.31; 74/567, 568 R; 464/1, 2, 160

[56] References Cited

U.S. PATENT DOCUMENTS

| | | | |
|---|---|---|---|
| 4,993,370 | 2/1991 | Hashiyama et al. | 123/90.17 |
| 5,181,485 | 1/1993 | Hirose et al. | 123/90.17 |
| 5,657,671 | 8/1997 | Morii | 123/90.17 |

FOREIGN PATENT DOCUMENTS 7-224619A 8/1995 Japan .

*Primary Examiner*—Weilun Lo
*Attorney, Agent, or Firm*—Kenyon & Kenyon

[57] ABSTRACT

A variable valve timing mechanism is provided at the distal end of an exhaust camshaft for changing a valve timing of an intake valve. An exhaust and intake camshafts are rotatably supported by a cylinder head, and both camshafts are connected by gears. The exhaust camshaft has a flange. The sleeve has large diameter portions at both ends of its journal, and has a distal end surface and a proximal end surface that is adjacent to the flange. A housing is fixed at the distal end of the exhaust camshaft. A ring gear is positioned between the housing and the sleeve. First and second hydraulic pressure chambers are defined at the ends of the ring gear. A pressure receiving surface is provided on the exhaust camshaft. The receiving surface is located in the second pressure chamber, while the distal end surface is located in the first pressure chamber.

18 Claims, 3 Drawing Sheets

ENGINE VALVE ADJUSTING APPARATUS

BACKGROUND OF THE INVENTION

The present invention relates to a variable valve timing mechanism provided in an engine to change the valve timing of intake valves or exhaust valves. More particularly, the present invention pertains to a variable valve timing mechanism that is driven by fluid pressure.

A variable valve timing mechanism (hereafter referred to as VVT) is provided in an engine to displace the rotational phase of a camshaft and adjust the valve timing of either an intake valve or an exhaust valve. The operation of the VVT optimizes the valve timing in accordance with the operating state of the engine (engine load, engine speed, and other factors). This improves fuel economy, increases engine power, and suppresses undesirable engine emissions regardless of different operating states of the engine.

Japanese Unexamined Patent Publication No. 7-224619 discloses an example of vane type VVT. The type of VVT described in the above patent is shown in FIG. 4. As shown in FIG. 4, a cylinder head 74 supports an exhaust and an intake side camshafts 72, 73. The camshafts 72, 73 actuate exhaust and intake valves 75, 76 respectively. The sleeve 77 is fitted onto the outer surface of the exhaust camshaft 72, and rotates relative to the exhaust camshaft 72. A sleeve 77 is supported by a bearing 78 of the cylinder head 74 at its journal 79. Clearances C1, C2 are provided between the journal 79 and the bearing 78 to allow the sleeve 77 to rotate. The sleeve 77 has stoppers 80, 81 at both ends of the journal 79. The stoppers 80, 81 limit the movement of the sleeve 77 in the axial direction. The sleeve 77 also has a distal end face 82 and a proximal end face 83. A plurality of outer teeth 84 is provided on the outer surface of the sleeve 77 near its distal end.

A housing 85, which includes a cover 86 and a timing pulley 87, is fixed to the distal end of the exhaust camshaft 72, and the housing 85 integrally rotates with the exhaust camshaft 72. A flange 88 is provided on the exhaust camshaft 72, and the flange 88 contacts with the proximal end face 83 of the sleeve 77. The cover 86 has a plurality of inner teeth 89. A pulley 87 is connected to the crankshaft (not shown) via a belt 90. The cover 86 is fixed to the pulley 87 to cover one side of the pulley 87 and the distal end of the camshaft 72. A clearance C3 is provided between the cover 86 and the distal end face 82 of the sleeve 77, while a clearance C4 is provided between the flange 88 and the proximal end face 83 of the sleeve 77. These clearances C3, C4 allow relative rotation between the sleeve 77 and the exhaust camshaft 72. A ring gear 91 is arranged between the cover 86 and the sleeve 77. The ring gear 91 rotates relative to the cover 86 and the sleeve 77. Inner teeth 92 project from the inner circumferential surface of the ring gear 91 while outer teeth 93 project from the outer circumferential surface of the ring gear 91. The teeth 92, 93 are helical splines. The inner teeth 92 are meshed with the outer teeth 84 of the sleeve 77, while the outer teeth 93 are meshed with the inner teeth 89 of the cover 86. In the housing 85, a first hydraulic pressure chamber 94 is defined at the left side of the ring gear 91 and a second hydraulic pressure chamber 95 is defined at the right side of the ring gear 91, as viewed in the drawing.

A drive gear 96, which is fixed to the sleeve 77, and a driven gear 97, which is fixed to the intake camshaft 73, connect the sleeve 77 and the intake camshaft 73.

When the crankshaft (not shown) is rotated, the housing 85 and the exhaust camshaft 72 are integrally rotated via the belt 90. The torque of the housing 85 is transmitted to the sleeve 77 via the ring gear 91 to rotate the intake camshaft 73 via the gears 96, 97. Thus, the exhaust valves 75 and the intake valves 76 are opened and closed under predetermined valve timings by the rotation of these camshafts 72 and 73. When hydraulic pressure is selectively applied to the first and second pressure chambers 94, 95, the ring gear 91 moves to the left or to the right along the axial direction of the camshaft 72 in accordance with the difference between the pressures applied to the end faces of the ring gear 91. This displaces the rotational phase of the sleeve 77 with respect to the camshaft 72 (and thus with respect to the crankshaft). Then, the rotational phase of the intake camshaft 73 is changed via the gears 96, 97. The valve timing of the intake valve 76 is adjusted by the rotational phase displacement of the camshaft 73.

A predetermined torque is produced when the camshaft 72 is rotated. The torque of the camshaft 72 includes a positive torque acting in the rotating direction of the camshaft 72 and a negative torque acting in a direction opposite to the rotating direction of the camshaft 72. The negative torque is produced by the reaction force of a valve spring (not shown) when the exhaust valve 75 is moved downward by the camshaft 72. The positive and negative torque on the camshaft 72 cause torque fluctuation, which has a tendency to become larger as the number of cylinders provided in the engine becomes smaller. The torque fluctuation is transmitted to the ring gear 91 through the inner teeth 89 of the cover 86 and the outer teeth 93 of the ring gear 91. Since the outer teeth 93 of the ring gear 91 are helical splines, the torque fluctuation of the camshaft 72 is converted to an axial force acting on the ring gear 91 and causes axial vibrations of the gear 91. The vibration of the ring gear 91 causes the sleeve 77 to chatter within the space provided by the clearances C3, C4. The proximal end face 83 frequently hits the flange 88 due to the vibration of the ring gear 91. This causes noise from the VVT 71.

SUMMARY OF THE INVENTION

Accordingly, it is an objective of the present invention to provide a variable valve timing mechanism for an engine that reduces noise produced by chattering between members that are rotatable with respect to a camshaft.

To achieve the above objective, an engine valve adjusting apparatus for an engine, wherein the engine includes, a crankshaft, a camshaft rotatably supported in the engine and driven by the crankshaft, a valve actuated by the camshaft. The adjusting apparatus serves to adjust the valve timing of the camshaft with respect to the crankshaft, and wherein the adjusting apparatus includes, a rotatable transmission shaft rotatably supported by the engine, wherein the rotatable transmission shaft is driven by the crank shaft, and wherein the rotatable transmission shaft has a first end and a second end, and wherein the rotatable transmission shaft is permitted to have a small amount of axial play to reduce friction when it rotates, a stop means for restricting the axial movement of the rotatable transmission shaft, a housing connected to the rotatable transmission shaft, the housing surrounding a portion of the rotatable transmission shaft, wherein one of the housing and the rotatable transmission shaft is driven in locked synchronism with the crank shaft and the other is driven in locked synchronism with the camshaft, a ring gear for transmitting power from the housing to the rotatable transmission shaft, wherein the ring gear is positioned between the rotatable transmission shaft and the housing and is coaxial with the rotatable transmission shaft, the ring gear being selectively movable in a first axial direction and in a second direction opposite to the first direction, wherein the axial movement of the ring gear changes the relative rotational relationship between the housing and the rotatable transmission shaft, a first chamber defined in the housing for receiving a hydraulic fluid to move the ring gear in the first direction, a second chamber defined in the housing for receiving a hydraulic fluid pressure to move the ring gear in the second direction, and a first hydraulic pressure receiving surface provided on the rotatable transmission shaft for receiving hydraulic fluid pressure from the first chamber, a second hydraulic pressure receiving surface provided on the rotatable transmission shaft for receiving hydraulic fluid pressure from the second chamber, wherein the first and the second pressure receiving surfaces are both urged in the same axial direction by the hydraulic fluid, regardless of which of the first and second chambers has a higher hydraulic pressure, to reduce chatter of the rotatable transmission shaft.

Other aspects and advantages of the invention will become apparent from the following description, taken in conjunction with the accompanying drawings, illustrating by way of example the principals of the invention.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION OF THE PREFERRED EMBODIMENT

Figure 3:
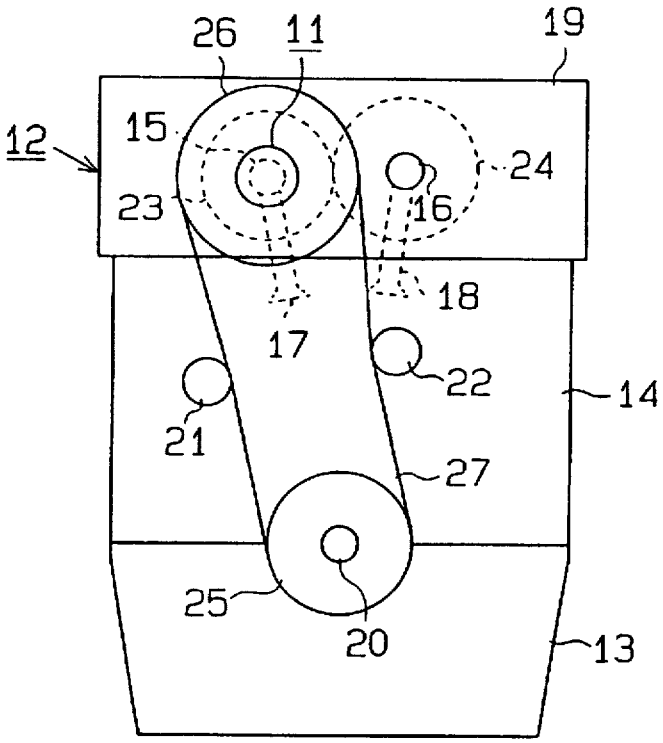
FIG. 3 is a diagrammatic front view showing an engine provided with the variable valve timing mechanism of FIG. 1.
Figure 4:
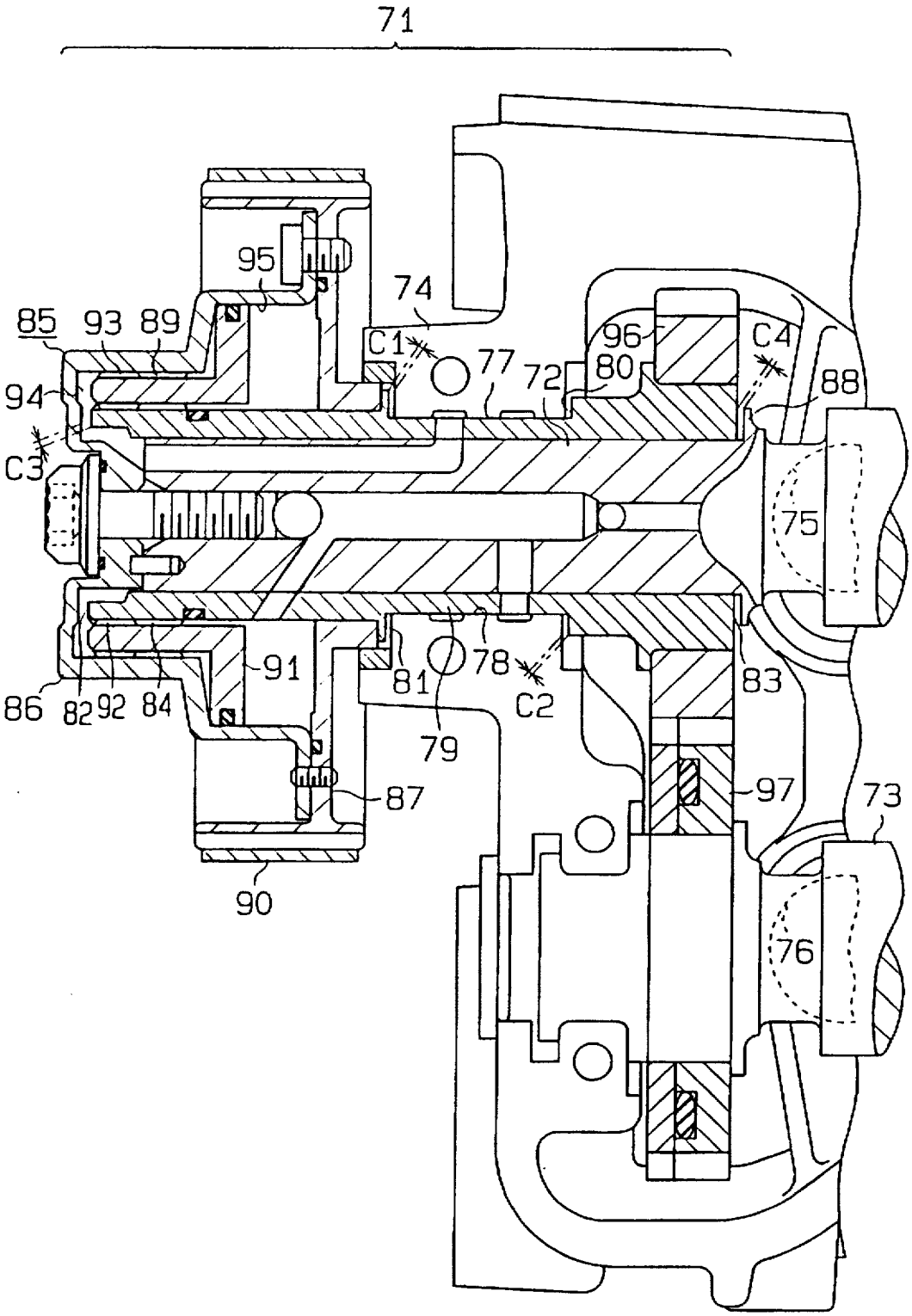
Fig.4(Prior Art)
FIG. 4 is a cross-sectional view showing a prior art variable valve timing mechanism.

An engine 12 having a VVT 11 is shown in FIG. 3. The engine 12 includes an oil pan 13 for reserving lubricating oil, a cylinder block 14 provided with cylinders (not shown), and a cylinder head 19. The cylinder head 19 supports camshafts 15, 16, exhaust valves 17, and intake valves 18.

The cylinder block 14 rotatably supports a crankshaft 20. Idlers 21, 22 are arranged at predetermined positions on the cylinder block 14. The cylinder head 19 rotatably supports the exhaust side camshaft 15 so as to open and close the exhaust valves 17. The cylinder head 19 also rotatably supports the intake side camshaft 16 for opening and closing the intake valves 18. The exhaust camshaft 15 and the intake camshaft 16 are connected by a drive gear 23 and a driven gear 24. The VVT 11 is provided at a distal end of the exhaust camshaft 15. Sprockets 25, 26 are provided at distal ends of the crankshaft 20 and the VVT 11, respectively. A chain 27 is wound about the sprockets 25, 26.

The rotation of the crankshaft 20 is transmitted to the exhaust camshaft 15 by means of the chain 27 and the sprockets 25, 26, and the exhaust camshaft 15 is rotated in fixed synchronism with the crankshaft 20. The rotation of the exhaust camshaft 15 is transmitted to the intake camshaft 16 via the gears 23, 24. This rotates the camshafts 15, 16 synchronously with the crankshaft 20. The rotation of the camshafts 15, 16 selectively opens and closes the associated exhaust and intake valves 17, 18 in accordance with a predetermined timing.

Figure 1:
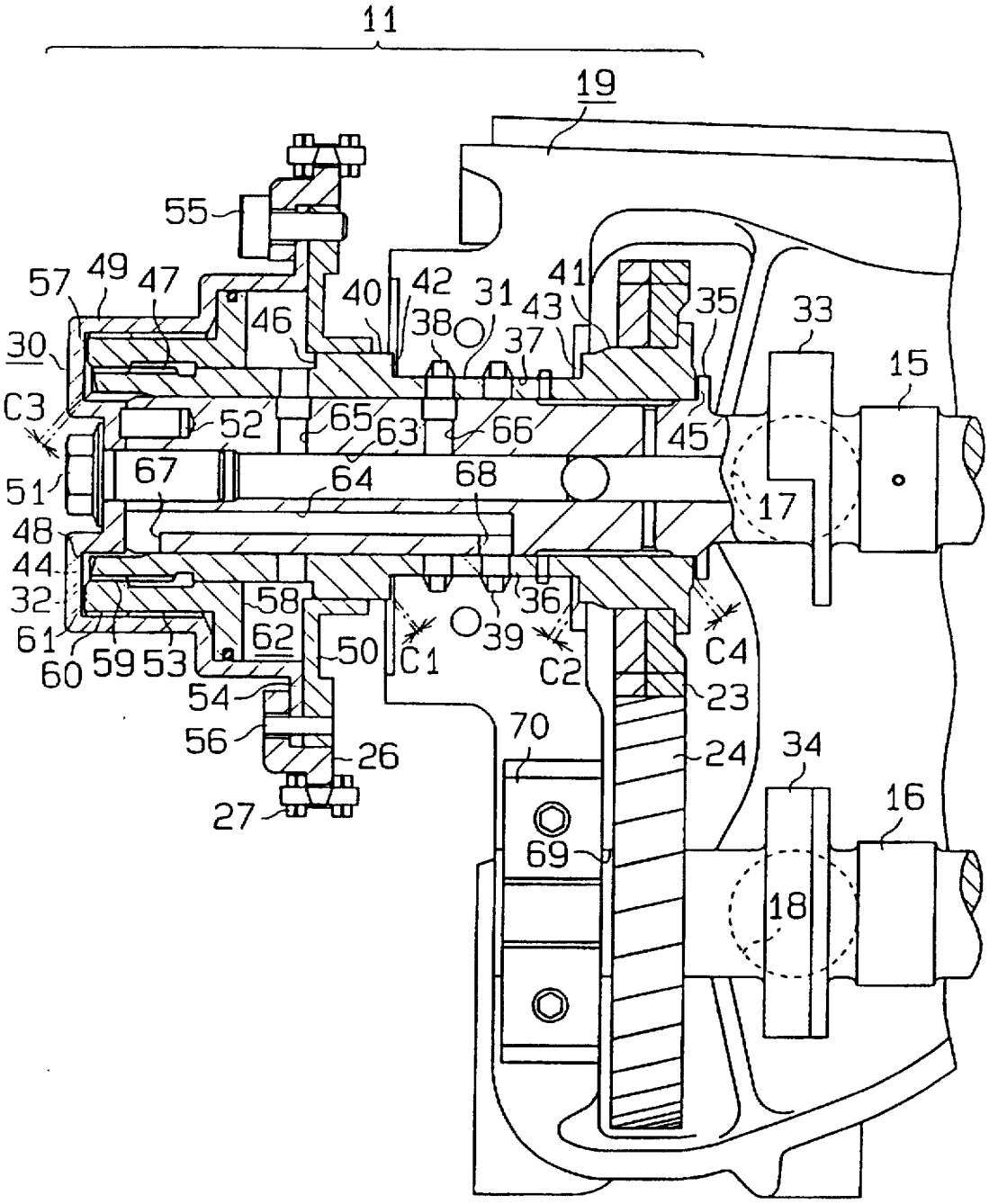
FIG. 1 is a cross-sectional view showing an embodiment of a variable valve timing mechanism according to the present invention.

FIG. 1 partially shows the valve train that is provided with the VVT 11. In FIG. 1, the distal end of the VVT 11 is shown toward the left while the proximal side of the VVT 11 is shown toward the right. The VVT 11 includes the exhaust camshaft 15, a housing 30, a sleeve 31 and a ring gear 32.

The camshafts 15, 16 have cams 33, 34 for actuating the valves 17, 18, respectively. The exhaust camshaft 15 has a flange 35 extending thereabout. The sleeve 31 is fitted onto the exhaust camshaft 15, and the sleeve 31 rotates relative to the exhaust camshaft 15. Also, the sleeve 31 is supported by a bearing 37 of the cylinder head 19 and a bearing cap (not shown) at its journal 36. Two oil grooves 38, 39 are formed on the bearing 37, and oil under pressure from an oil circuit (not shown) is supplied to the oil grooves 38, 39.

The sleeve 31 has large diameter portions 40, 41. The large diameter portions 40, 41 include stopper portions 42, 43, respectively, which engage with the bearing 37. This engagement between stopper portion 42, 43 and the bearing 37 restricts axial movement of the sleeve 31. A first clearance C1 is provided between the stopper portion 42 and the bearing 37 while a second clearance C2 is provided between the bearing 37 and the stopper portion 43. These clearances C1, C2 allow the sleeve 31 to rotate smoothly. The sleeve 31 has a distal end face 44 and a proximal end face 45.

Figure 2:
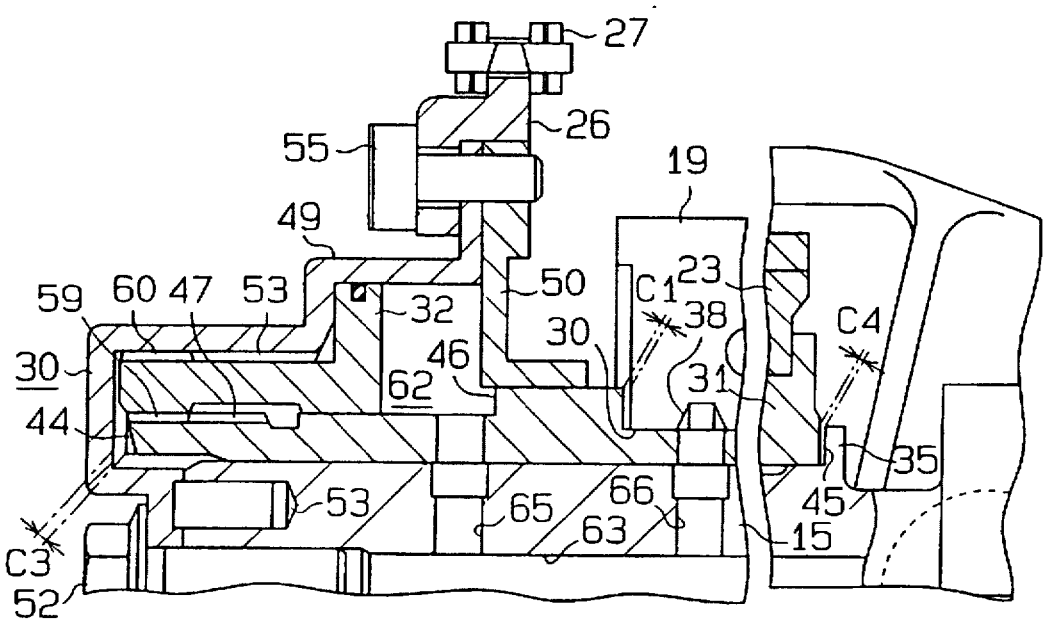
FIG. 2 is a partial enlarged cross-sectional view of a portion of FIG. 1.

As shown in FIGS. 1 and 2, a pressure receiving surface 46, which is one side of the large diameter portion 40, is provided about the sleeve 31. The receiving surface 46 faces a direction that is the opposite to the direction that the end face 45 faces. A plurality of outer teeth 47 is provided on the outer surface of the sleeve 31 near its distal end. The drive gear 23 is fixed on the large diameter portion 41 of the sleeve 31. An oil groove 48 formed on the distal end of the sleeve 31.

As shown FIG. 1, the housing 30 is constituted by a cover 49 and plate 50. The cover 49 is fastened at the distal end of the exhaust camshaft 15 by a bolt 51 and a pin 52. The cover 49 has a plurality of inner teeth 53 on its inner surface. Also, the cover 49 has a flange 54 at its periphery. The plate 50 and the sprocket 26 are fastened to the flange 54 by a plurality of bolts 55 and pins 56. The chain 27 is wound about a ring-like sprocket 26. The exhaust camshaft 15, the cover 49, the plate 50 and the sprocket 26 are formed integrally and rotate relative to the sleeve 31. A third clearance C3 is provided between the distal end face 44 and the cover 49, while a fourth clearance C4 is provided between the proximal end face 45 and the flange 35. The widths of clearances C1–C4 are shown in an exaggerated manner in FIGS. 1 and 2. The widths of the clearances C3, C4 are set within a range that allows the sleeve 31 to rotate relative to the exhaust camshaft 15, and a relationship among the widths of the clearances C1–C4 are shown below.

$$(C3+C4)>(C1+C2)$$

The cylindrical ring gear 32 is arranged between the cover 49 and the sleeve 31. Thus, the ring gear 32 connects the cover 49 to the sleeve 31. The ring gear 32 rotates relative to the cover 49 and the sleeve 31. The ring gear 32 has a distal surface 57 and a proximal surface 58, to which oil pressure is applied. Also, the ring gear 32 has a plurality of inner teeth 59 and outer teeth 60 on its surface. The teeth 59, 60 are helical splines. The inner teeth 59 are meshed with the outer teeth 47 of the sleeve 31, while the outer teeth 60 are meshed with the inner teeth 53 of the cover 49.

In the housing 30, a first hydraulic pressure chamber 61 is defined at the distal side of the ring gear 32 and a second hydraulic pressure chamber 62 is defined at the proximal side of the ring gear 32, as shown in FIG. 1. The receiving surface 46 is opposed to the proximal surface 58 of the ring gear 32. The receiving surface 46 provided on the sleeve 31 constitutes a portion of the second pressure chamber 62. Oil pressure in the second pressure chamber 62 presses the receiving surface 46 toward the flange 35.

An oil passage 63, which extends through the exhaust camshaft 15, is connected with the second pressure chamber 62 while an oil passage 64, which extends through the exhaust camshaft, is connected with the first pressure chamber 61. The exhaust camshaft 15 and the sleeve 31 have four oil holes 65, 66, 67, 68, which extend radially. The oil hole 65 connects the oil passage 63 to the second pressure chamber 62, and the oil hole 66 connects the oil passage 63 to the oil groove 38. The oil hole 67 connects the oil passage 64 to the first pressure chamber 61, and the oil hole 68 connects the oil passage 64 to the oil groove 39.

The intake camshaft 16 is rotatably supported by a bearing 69 and a bearing cap 70 of the cylinder head 19. The driven gear 24 is fixed to the intake camshaft 16 and is meshed with the drive gear 23.

When hydraulic fluid is supplied to the first and second pressure chambers 61, 62 through the oil passages 64, 63, the fluid pressure is applied to the surfaces 57, 58, respectively, of the ring gear 32. The hydraulic pressure rotates and moves the ring gear 32 distally or proximally in the axial direction. When the ring gear 32 is rotated relatively to the exhaust camshaft 15 and the sleeve 31, the rotational phase of the sleeve 31 with respect to the rotational phase of the exhaust camshaft 15 is changed. This displaces the rotational phase of the intake camshaft 16 via gears 23, 24, and adjusts the valve timing of the intake valve 18.

The supply of hydraulic fluid to the first and second pressure chambers 61, 62 is controlled by the hydraulic pressure circuit. The ring gear 32 is moved axially by appropriately controlling the hydraulic pressure supplied to the first and second pressure chambers 61, 62. When the hydraulic pressure in the first pressure chamber 61 is substantially equal to the hydraulic pressure in the second chamber 62, the ring gear 32 is held fixed at one position. Continuous (non-stage) hydraulic pressure control enables continuous changes in the valve timing of the intake valve 18. The valve timing may also be changed through two-stage or multiple-stage hydraulic control.

When hydraulic fluid is supplied to the first pressure chamber 61 in the state shown in FIG. 1, the hydraulic fluid is also supplied to the third clearance C3. Hydraulic pressure is thus applied to the end surface 44 of the sleeve 31 in addition to the distal surface 57 of the ring gear 32. The pressure presses the distal end face 44 of the sleeve 31 in the proximal direction (to the right in FIG. 1). The sleeve 31 is moved toward the flange 35 to close the clearance C4, thus the proximal end face 45 of the sleeve 31 is urged toward the flange 35. The rightward movement of the sleeve 31 is restricted by the abutment of the proximal end face 45 against the flange 35. The sleeve 31 is kept pressed in the proximal direction as long as hydraulic pressure is applied to the first pressure chamber 61 even when the movement of the ring gear 32 is completed. This maintains the abutment of the proximal end face 45 against the flange 35.

When hydraulic pressure is supplied to the second pressure chamber 62 when the ring gear 32 is moved to its proximal position (to the right as viewed in FIG. 1), the hydraulic pressure is also applied to the receiving surface 46 in addition to the proximal surface 58 of the ring gear 32. The pressure presses the receiving surface 46 of the sleeve 31 toward the flange 35. The sleeve 31 moves toward the flange 35 to close the clearance C4, thus the proximal end face 45 of the sleeve 31 moves toward the flange 35. The rightward movement of the sleeve 31 is restricted by the abutment of the proximal end face 45 against the flange 35. The sleeve 31 is kept pressed to the right as long as hydraulic pressure is applied to the second pressure chamber 62, even when the movement of the ring gear 32 is completed. This maintains the abutment of the proximal end face 45 against the flange 35.

As described above, whether the hydraulic pressure is applied to the first pressure chamber 61 or the second pressure chamber 62, the proximal end face 45 is urged toward the flange 35. This restricts the axial movement of the sleeve 31. The magnitude of the force that presses the sleeve 31 to the right is sufficient for offsetting the axial force acting on the ring gear 32 that is produced by the torque fluctuation of the camshaft 15. In addition, the magnitude of the force is small enough to prevent a significant increase in the frictional force produced between the proximal end face 45 and the flange 35.

The helical splines convert the torque fluctuation of the camshaft 15 in the rotational direction of the camshaft 15 to force fluctuation in the axial direction of the camshaft 15. However, the sleeve 31 is constantly pressed toward the right as described above despite such force fluctuation acting on the ring gear 32. This prevents chattering and reduces noise that may be caused by the chattering.

In this embodiment, the receiving surface 46 is simply provided on the sleeve 31, so the construction of the VVT 11 is not complicated compared to the prior art VVT.

Although only one embodiment of the present invention has been described herein, it should be apparent to those skilled in the art that the present invention may be embodied in many other specific forms without departing from the spirit or scope of the invention. Particularly, it should be understood that the invention may be embodied in the following forms.

(1) The force that presses the sleeve 31 to the right may be altered by appropriately altering the areas of the receiving surface 46 and the area of the end surface 44. Such alterations adjust the forces used to offset the torque fluctuation force acting on the sleeve 31 to a desirable level. For example, such an adjustment may be used to suppress the friction produced between the proximal end face 45 and the flange 35 to ensure an immediate response by the VVT 11.

(2) Each of the sprockets 25, 26 may be replaced with timing pulleys and the chain 27 may be replaced with a timing belt. Also, the sprocket 26 and chain 27 may be moved to the opposite end of the camshaft 15. In such a VVT, the opposite end of the camshaft is coupled to the crankshaft.

(3) Although the present invention is employed in a VVT 11 that changes the timing of the intake valve 18, the present invention may also be employed in a VVT that changes the timing of the exhaust valve 17.

Therefore, the present embodiment is to be considered as illustrative and not restrictive and the invention is not to be limited to the details given herein, but may be modified within the scope and equivalence of the appended claims.

What is claimed is:

1. An engine valve adjusting apparatus for an engine, wherein the engine includes:

a crankshaft;

a camshaft rotatably supported in the engine and driven by the crankshaft;

a valve actuated by the camshaft;

wherein the adjusting apparatus serves to adjust the valve timing of the camshaft with respect to the crankshaft, and wherein the adjusting apparatus comprises:

a rotatable transmission shaft rotatably supported by the engine, wherein the rotatable transmission shaft is driven by the crankshaft, and wherein the rotatable transmission shaft has a first end and a second end, and wherein the rotatable transmission shaft is permitted to have a small amount of axial play to reduce friction when it rotates;

a stop means for restricting the axial movement of the rotatable transmission shaft;

a housing connected to the rotatable transmission shaft, the housing surrounding a portion of the rotatable transmission shaft, wherein one of the housing and the rotatable transmission shaft is driven in locked synchronism with the crankshaft and the other is driven in locked synchronism with the camshaft;

a ring gear for transmitting power from the housing to the rotatable transmission shaft, wherein the ring gear is positioned between the rotatable transmission shaft and the housing and is coaxial with the rotatable transmission shaft, the ring gear being selectively movable in a first axial direction and in a second direction opposite to the first direction, wherein the axial movement of the ring gear changes the relative rotational relationship between the housing and the rotatable transmission shaft;

a first chamber defined in the housing for receiving a hydraulic fluid pressure to move the ring gear in the first direction;

a second chamber defined in the housing for receiving a hydraulic fluid pressure to move the ring gear in the second direction; and a first hydraulic pressure receiving surface provided on the rotatable transmission shaft for receiving hydraulic fluid pressure from the first chamber;

a second hydraulic pressure receiving surface provided on the rotatable transmission shaft for receiving hydraulic fluid pressure from the second chamber;

wherein the first and the second pressure receiving surfaces are both urged in the same axial direction by the hydraulic fluid, regardless of which of the first and second chambers has a higher hydraulic pressure, to reduce chatter of the rotatable transmission shaft.

2. An apparatus according to claim 1, wherein the rotatable transmission shaft is a sleeve coaxially and rotatably fitted on a rotatable shaft.

3. An apparatus according to claim 1, wherein the camshaft is connected to the rotatable transmission shaft by a transmission means so that the camshaft is driven in locked synchronism with the rotatable transmission shaft.

4. The apparatus as set forth in claim 1, wherein said rotatable transmission shaft includes a large diameter portion, the large diameter portion having a diameter greater than that of an adjacent portion of the rotatable transmission shaft, wherein a first side of the large diameter portion forms the second pressure receiving surface.

5. The apparatus as set forth in claim 1, wherein said first end of said rotatable transmission shaft has a first end surface located in the first chamber, and wherein the first end surface forms said first pressure receiving surface.

6. An engine valve adjusting apparatus for an engine, wherein the engine includes:

a first camshaft and a second camshaft rotatably supported in the engine, the first camshaft having a first end and a second end;

a first valve actuated by the first camshaft;

a second valve actuated by the second camshaft;

wherein the adjusting apparatus serves to adjust the valve timing of one of the first valve and the second valve, and wherein the adjusting apparatus comprises:

a rotatable transmission shaft rotatably supported by the engine, wherein the rotatable transmission shaft is a sleeve mounted coaxially on the first camshaft and is rotatable relative to the first camshaft, and wherein the sleeve has a first end and a second end corresponding to the first and second ends of the first camshaft;

a stop means located on the first camshaft for restricting the axial movement of the sleeve by abutting with the second end of the sleeve;

a transmission means for connecting the sleeve to the second camshaft;

a housing fixed to a first end of the first camshaft, the housing surrounding a portion of the first camshaft and a portion of the sleeve;

a ring gear for transmitting power from the housing to the first camshaft, wherein the ring gear is positioned between the sleeve and the housing and is coaxial with the first camshaft, the ring gear being selectively movable in a first axial direction toward the stop means and in a second direction opposite to the first direction, wherein the movement of the ring gear changes the relative rotational relationship between the housing and the sleeve;

a first chamber defined in the housing for receiving a hydraulic fluid pressure to move the ring gear in the first direction;

a second chamber defined in the housing for receiving a hydraulic fluid pressure to move the ring gear in the second direction; and a first hydraulic pressure receiving surface provided on the sleeve and located in the first chamber;

a second hydraulic pressure receiving surface provided on the sleeve and located in the second chamber, wherein the first and the second pressure receiving surfaces each receive a force resulting from hydraulic fluid pressure directed toward the first direction.

7. The apparatus as set forth in claim 6, wherein said ring gear has a first end surface for receiving a force directed toward the first direction, and the ring gear has a second end surface for receiving a force directed toward the second direction, and wherein said second pressure receiving surface includes a receiving surface opposed to the second end surface of the ring gear.

8. The apparatus as set forth in claim 7, wherein said second receiving surface constitutes a portion of the second chamber, and wherein the second receiving surface receives the pressure in the second chamber.

9. The apparatus as set forth in claim 8, wherein said first end of said sleeve has a first end surface located in the first chamber, and wherein the first end surface forms said first pressure receiving surface.

10. The apparatus as set forth in claim 9, further comprising:

outer teeth fixed to the sleeve;

inner teeth fixed to the ring gear, wherein said outer teeth of the sleeve engage the inner teeth of the ring gear for forming an inner coupling;

outer teeth fixed to the ring gear, inner teeth fixed to the housing, wherein said inner teeth fixed to the housing engage the outer teeth fixed to the ring gear for forming an outer coupling;

a helical spline formed by at least one of the outer coupling and the inner coupling.

11. The apparatus as set forth in claim 10, wherein said sleeve includes a large diameter portion, the large diameter portion having a diameter greater than that of other adjacent portions of the sleeve, wherein a first side of the large diameter portion forms the first receiving surface.

12. The apparatus as set forth in claim 10, wherein said sleeve has a journal, and wherein the engine has a bearing for supporting the sleeve at the journal, and wherein the sleeve has a stopper at each end of the journal for restricting the axial movement of the sleeve.

13. The apparatus as set forth in claim 11, wherein said journal extends between the housing and the stop means on the first camshaft, and wherein the housing and the first end surface of the sleeve define a first clearance while the stop means and the second end surface define a second clearance, and wherein the first and second clearances allow the sleeve to rotate relative to the first camshaft.

14. The apparatus as set forth in claim 11, wherein said transmission means includes a first gear fixed to the sleeve, and a second gear fixed to the second camshaft, and wherein the second gear engages with the first gear.

15. The apparatus as set forth in claim 11, wherein engine has a crankshaft and a transmitting means for transmitting power from the crankshaft to the housing.

16. The apparatus as set forth in claim 11, wherein said first valve is an exhaust valve, and wherein said second valve is an intake valve.

17. The apparatus as set forth in claim 11, further comprising:

a first passage defined in the first camshaft, the first passage being connected with the first chamber; and a second passage defined in the first camshaft and the sleeve, the second passage being connected with the second chamber.

18. The apparatus as set forth in claim 6, wherein the second end surface of the sleeve is pressed toward the stop means by the hydraulic pressure force received by the second pressure receiving surface.

* * * * *